US006736073B2

(12) United States Patent
Ryburg

(10) Patent No.: US 6,736,073 B2
(45) **Date of Patent: *May 18, 2004**

(54) WORK SURFACE FOR LUGGAGE AND LUGGAGE CARRIERS

(76) Inventor: Jon B. Ryburg, 566 Landings Blvd., Ann Arbor, MI (US) 48103

( * ) Notice: Subject to any disclaimer, the term of this patent is extended or adjusted under 35 U.S.C. 154(b) by 0 days.

This patent is subject to a terminal disclaimer.

(21) Appl. No.: 10/228,234

(22) Filed: Aug. 26, 2002

(65) Prior Publication Data

US 2003/0000429 A1 Jan. 2, 2003

Related U.S. Application Data

(63) Continuation-in-part of application No. 09/643,079, filed on Aug. 21, 2000, now Pat. No. 6,439,134, which is a continuation-in-part of application No. 08/970,400, filed on Nov. 14, 1997, now Pat. No. 6,105,508.

(51) Int. Cl.[7] ..... A47B 23/00
(52) U.S. Cl. ..... 108/42; 108/48
(58) Field of Search ..... 108/42, 48, 150; 248/161, 157, 229.1, 229.11, 229.12, 231.41, 229.22; 190/11, 12 A, 15.1

(56) References Cited

U.S. PATENT DOCUMENTS

| | | | | |
|---|---|---|---|---|
| 2,319,521 A | | 5/1943 | Schneider et al. | |
| 2,791,476 A | | 5/1957 | Atwill | |
| 2,867,484 A | | 1/1959 | Jennings | |
| 5,329,860 A | | 7/1994 | Mattesky | |
| 5,337,682 A | | 8/1994 | Wiseman | |
| 5,528,993 A | | 6/1996 | Vincelli | |
| 5,535,973 A | | 7/1996 | Bailey et al. | |
| 6,079,678 A | | 6/2000 | Schott et al. | |
| 6,105,508 A | * | 8/2000 | Ryburg | 108/42 |
| 6,439,134 B1 | * | 8/2002 | Ryburg | 108/42 |

FOREIGN PATENT DOCUMENTS

| | | |
|---|---|---|
| EP | 0031414 | * 10/1980 |

* cited by examiner

*Primary Examiner*—Jose V. Chen
(74) *Attorney, Agent, or Firm*—Harness, Dickey & Pierce, P.L.C.

(57) ABSTRACT

A portable work station having a work surface, a leg assembly operably coupled to the work surface and a clamp coupled to the work surface, for mounting the portable work station to an upright support. The work surface and leg assembly may be foldable into a compact unit for storage and transportation. The portable work station is particularly well-suited for use in conjunction with wheeled luggage having an extendable handle.

11 Claims, 9 Drawing Sheets

WORK SURFACE FOR LUGGAGE AND LUGGAGE CARRIERS

CROSS-REFERENCE TO RELATED APPLICATIONS

This application is a continuation-in-part of U.S. patent application Ser. No. 09/643,079 filed on Aug. 21, 2000 now U.S. Pat. No. 6,439,134 which is a continuation-in-part of U.S. patent application Ser. No. 08/970,400 filed on Nov. 14, 1997 now U.S. Pat. No. 6,105,508. The disclosure of the above applications are incorporated herein by reference.

FIELD OF THE INVENTION

The present invention relates generally to portable secretaries and more particularly to a work surface which attaches to a luggage carrier, enabling a traveler to establish a portable office while waiting in airport terminals and the like.

BACKGROUND OF THE INVENTION

Several contemporaneous trends are pointing to the need for mobile amenities usually relegated to established or stationary office environments. An increasing number of business people rely on travel in their jobs because of air travel and enhanced airport security. Such individuals often find themselves spending a considerable amount of time in public places waiting for departures or arrivals. Concurrently, computing machinery has become increasingly portable with notebook computers and laptops equipped with sufficient hard disk and CD-ROM storage to carry sophisticated application programs and enormous files with work related information. Indeed, terms such as "mobile computing" and "nomadic computing" are becoming more prevalent.

Additionally, for the sake of convenience, an increasing number of air travelers are resorting to carry-on luggage, as opposed to checked luggage, to avoid loss in transit and circumvent delays associated with baggage claim. Due to the increase in carry-on luggage, more individuals are using rolling carts and other structural mechanisms to assist in transferring bags from one place to the next, removing the need to lift and carry these cumbersome items. Likewise, the types of luggage used by travelers has evolved to include integrated wheels and handles. As a result, it is common to see frequent fliers with such luggage carriers.

SUMMARY OF THE INVENTION

This invention addresses such trends by providing a portable work station having a work surface that may be secured to a luggage carrier. As used herein, a luggage carrier is intended to encompass all types of luggage-related devices including but not limited to luggage carrier, luggage carts, rolling or sliding luggage, rolling or sliding cases and the like. Such a work surface provided by the invention is not only preferably universal in its coupling to existing luggage carriers, but is substantial and stable enough to support at least two 8½×11 documents side-by-side or a laptop computer.

The work station attaches to an upright support member such as the vertical extensible handle support members common to a wide variety of wheeled luggage carriers by grasping or frictionally engaging the support members with a clamping mechanism. The height of the work surface may be varied depending on whether the user is in a seated or standing position. The front of the work surface is supported by a collapsible rod assembly which varies in length according to the position of the work surface and extends down to the floor or alternately to the upright support member. The rod assembly in conjunction with the support member creates a stable arrangement to support the work surface. The rod assembly may be positioned between the legs of a user so that in a seated position, the legs of the user will fit underneath the work surface allowing easy access to the work surface.

DETAILED DESCRIPTION OF THE PREFERRED EMBODIMENT

With reference to the figures, the present invention is directed to a portable workspace solution which is assembled in combination with a luggage carrier to provide a suitable work surface. The preferred embodiments are described below in connection with a luggage carrier in the form of rolling luggage. However, one skilled in the art will recognize that the present invention may be used with other luggage carriers including but not limited to luggage carts, rolling or sliding luggage, rolling or sliding cases and the like. Thus, the term luggage carrier is used in a broad sense to encompass any or all of these such devices.

Figure 1:
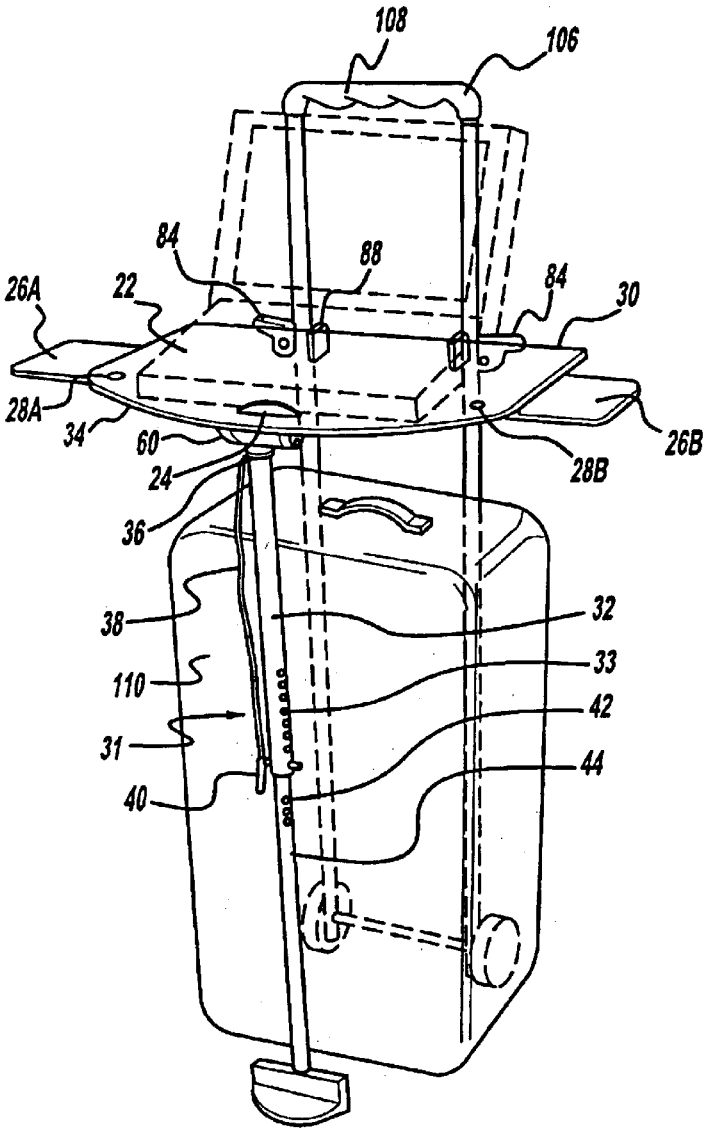
FIG. 1 is a perspective view of the first embodiment of the present invention.

With reference now to FIG. 1, a perspective view of the first embodiment of the present invention is shown. The first embodiment includes a work surface 22 which engages with one or more vertical extensible handle support members 106, forming part of an assembly which connects a handle portion 108 to luggage 110 through an engaging means comprised of cams 84 and uprights 88. Although in this figure two vertical extensible handle support members 106 are shown, more or fewer may be present. The work surface 22 may be positioned in any manner upon the luggage carrier that allows the engaging means to couple with the vertical extensible handle support members 106. It should also be noted that the various dimensions depicted in FIG. 1, including the size of work surface 22, may be varied according to the circumstances and still remain within the spirit and scope of this invention.

The work surface 22 is generally a flat sheet cut or formed to the depicted shape, although other similar shapes may be used with the same general result. The work surface 22 provides the area from which a laptop computer or other office device may be placed in order to provide a suitable work platform. In the preferred embodiment, the work surface 22 is provided in the form of a hardwood-surfaced plywood having a thickness of ¼", but a variety of other dimensions and materials may be used. The alternate materials include various woods, plastics, metals, composites, and combination of these materials. Alternate embodiments of the work surface 22 include hinged configurations which allow the work surface 22 to be folded or collapsed into a more portable form.

As shown in FIG. 1, the work surface 22 includes a stop 24 mounted to its top surface, providing a stable point of contact for a laptop computer or other office equipment. The work surface 22 is also pivotally coupled to auxiliary work surfaces 26A and 26B by pivots 28A and 28B. Auxiliary work surfaces 26A and 26B are normally located underneath work surface 22 but may be swiveled from underneath work surface 22 to an extended position with relation to work surface 22. Work surfaces 26A and 26B provide additional surface area for assorted office implements such as a computer mouse or files.

Work surface 22 is frictionally coupled to the vertical extensible handle support members 106 attached to luggage 110 by a pair of rotating cams 84 and a pair of uprights 88. Rotating cams 84 and uprights 88 are coupled to the back end 30 of work surface 22 and create a stable foundation from which to further erect the present invention. An additional support structure, shown in FIG. 1 as rod assembly 31, is operably coupled to the front of work surface 34. The rod assembly includes a support member 60 operably coupled to said work surface 22 and further coupled to support rod 32 having apertures 33. An adjustment pin 40 is elastically coupled to support rod 32 by elastic cord 38 and coupling means 36. The coupling means 44 may be a circular elastic band or other device which prevents the loss of the adjustment pin 40. The elastic cord 38 is designed to allow maximum freedom of movement for the adjustment pin 40 while minimizing its slack. The adjustment pin 40 rigidly joins support rod 32 to support rod 44 having apertures 42 by penetrating apertures 33 and 42. Support rod 44 is coupled to upright member 46 which is further coupled to foot 48, creating a structure which supports work surface 22 on it front end 34. This first embodiment of the rod assembly 31 may be adjusted to fit the height of any luggage by operably sliding support rod 44 into support rod 32 in a telescopic fashion until the desired elevation is reached. The adjusting pin 40 then fixes the relative position of support rods 44 and 32 to create a rigid structure from which the working surface 22 may rest on.

Figure 1A:
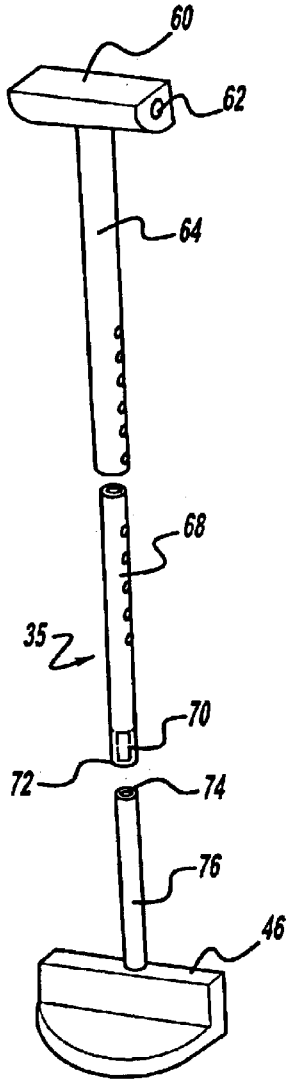
FIG. 1A is a perspective view of a second embodiment of the rod assembly.

A second embodiment of the rod assembly 35 is shown in FIG. 1A. This second embodiment includes support member 60 and support rods 64 and 68 having apertures which may be coupled in the same manner as the first embodiment. This embodiment of the present invention also includes a third support rod 76 having threaded aperture 74 located in its top surface. Threaded aperture 74 couples support rod 68 to support rod 76 by a threaded member 70 located in recess 72. Support rod 76 is placed into recess 72 until threaded member 70 slightly penetrates threaded aperture 74. Support rod 76 is then rotated, with reference to support rod 68, until threaded member 70 and threaded aperture 74 are fully engaged, creating a rigid structure from which the work surface 22 may rest, as in the first embodiment. This second embodiment of the rod assembly 35 allows flexibility in its break down and reduces the overall length of the separate support rods so that they may be better stored under smaller dimensioned work surfaces 22.

Figure 2:
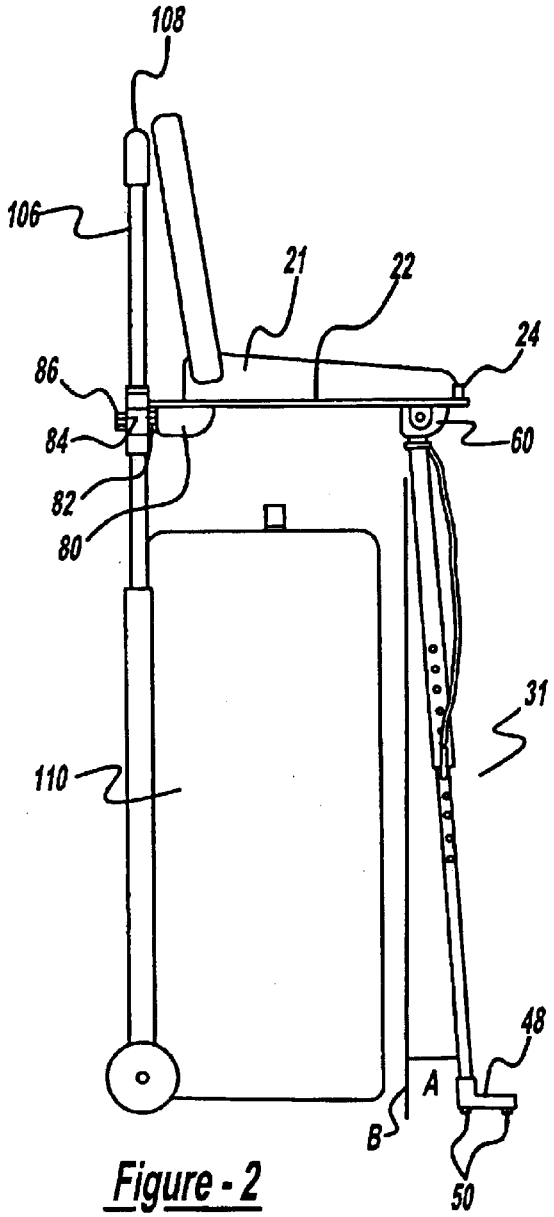
FIG. 2 is a side elevation view of the first embodiment of the present invention.

FIG. 2 is a side elevational view of the first embodiment of the present invention illustrating its operation. Rotating cams 84 are coupled to bushings 82 and bracket 80 by fasteners 86 which penetrates cams 84, bushings 82 and bracket 80 in a fashion which allows the rotation of cams 84. Vertical extensible handle support members 106 of luggage 110 are placed between rotating cams 84 and uprights 88 at the desired height, and cams 84 are rotated until they pinch or constrain the vertical extensible handle support members 106 against the uprights 88. Uprights 88 are covered with a resilient frictional compressible material such that they better grip the vertical extensible handle support members 106 and prevent slippage. In another embodiment cams 84 have been formed with a concave surface to better engage with the generally cylindrical shape of the handle support members 106.

As shown in FIG. 2, rod assembly 31 is further assembled to the desired vertical height and rotated so that angle A measured from vertical line B is approximately 15 degrees. As rod assembly 31 rotates about pivot point 62, it will come to a stop when the top surface of support member 60 contacts the underside of the work surface 22, creating a rigid foundation for supporting the front 34 of work surface 22. Upon completion of the rotation, angle A is approximately 15 degrees and foot 48 is in contact with the ground through points 50. In one embodiment of the present invention, there are three points 50 spaced in a triangular manner on the bottom of foot 48 to create a tripod arrangement. When the rod assembly 31 is assembled in the manner as detailed above, the three points 50 will contact the floor simultaneously, creating a sturdy tripod base which braces the rod assembly 31. Laptop 21 can then be placed and operated upon the finished structure with confidence in the steadiness of the work surface 22. A person skilled in the art would recognize that the base may be configured in numerous permutations that would not depart from the spirit and scope of the disclosed invention.

Figure 3:
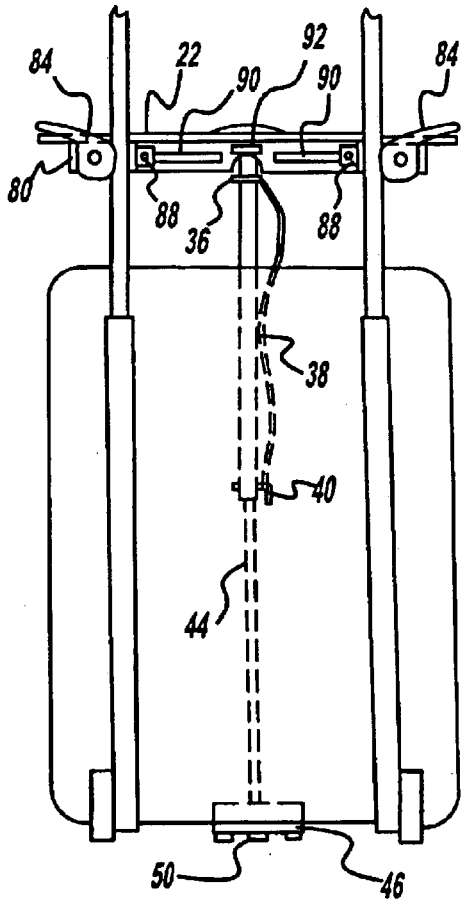
FIG. 3 is a rear elevation view of the first embodiment of the present invention.

FIG. 3 is a rear elevational view of the first embodiment of the present invention. Bracket 80 is coupled to the underside of work surface 22 and its internal edges define slots 90 which are operably coupled to cams 84 and uprights 88. Cams 84 and uprights 88 may be moved along slot 90, varying their relative spacing, to accept any luggage handle configuration. Once cams 84 and uprights 88 are positioned in the desired manner they are locked in position with a securing means. In one embodiment of the present invention, the securing means is a fastener assembly 79 comprised of threaded fasteners 86 disposed through a bore in cams 84 and uprights 88, further disposed through slot 90, and coupled to threaded nuts 85 which are tightened to secure cams 84 and uprights 88. Washers with a coarse surface may be used in addition to the threaded nuts 85 and threaded fasteners 86 to help secure the cams 84 and uprights 88 against bracket 80. The coarse surface of the washers will increase friction against bracket 80 to help prevent the movement of cams 84 and uprights 88.

Figure 4:
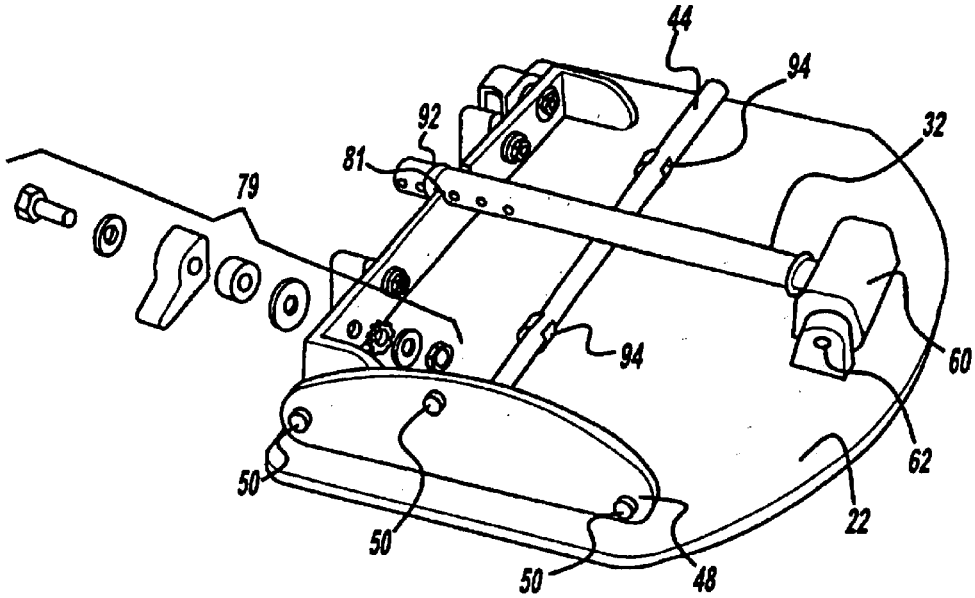
FIG. 4 is a bottom perspective view of the first embodiment of the present invention in a collapsed state.

FIG. 4 is a perspective bottom view of the first embodiment of the present invention in a collapsed state. The present invention when not being used must be reduced to a small volume in order to be convenient and portable. The rod assembly 31 is collapsed by removing pin 40 and disengaging support rods 32 and 44. Support rod 32 may be rotated around pivot assembly 62 until it reaches a fully collapsed position under work surface 22. Bracket 80 has external edges which define a generally semicircular cut-out 81 in which the end of support rod 32 may be placed in and then restrained with elastic band 92. Support rod 44 is then coupled to grips 94 underneath work surface 22 in a manner that positions foot 48 within the perimeter of work surface 22. In other embodiments, which include a rod assembly composed of three or more rod supports, extra grips are added to secure the additional rods within the perimeter of work surface 22. The grips 94 may be constructed from Velcro®, hooks, clamp, clasps, or other securing devices.

Figure 5:
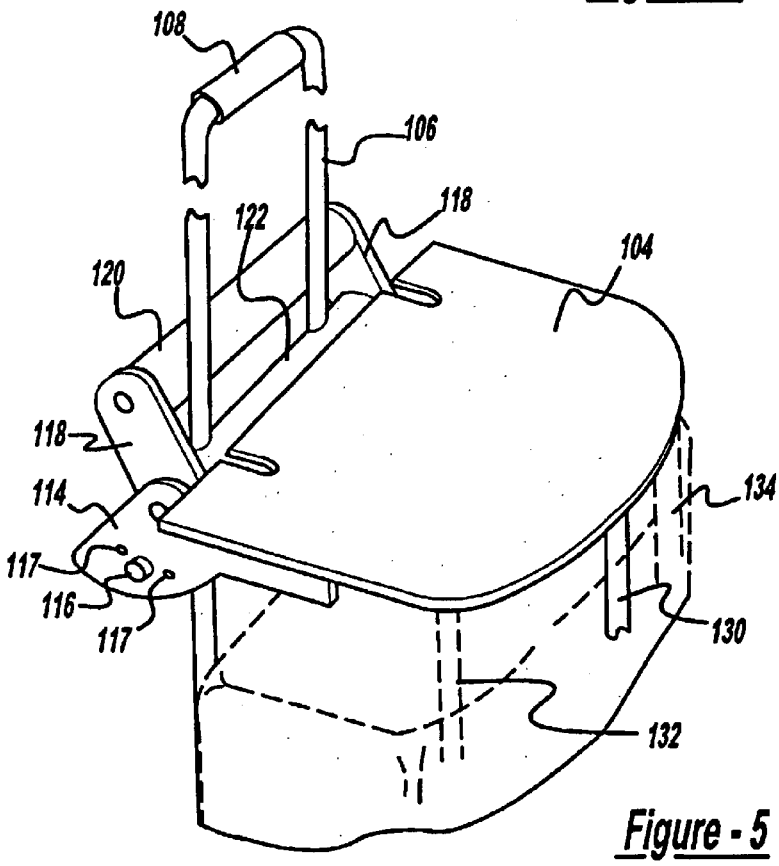
FIG. 5 is a perspective view of the second embodiment of the present invention.

In a second embodiment of the present invention, illustrating a second engaging means shown in FIG. 5, a pair of side support members 114 (only one of the support members 114 is visible) are adhered transversely to the bottom of a work surface 104 similar to the work surface of the first embodiment. These side support members 114 are pivotally attached to members 118 which support horizontal members 120 and 122. Horizontal members 120 and 122 straddle the vertical extensible handle support members 106 in diagonal fashion as shown in FIG. 5. Preferably, horizontal members 120 and 122 are fashioned from rigid rods of wood or other suitable light weight materials such as a tubular metal, polymer or composite. To enhance the frictional gripping between the horizontal members 120 and extensible handle support members 106, the horizontal members 120 are preferably coated or covered with a resilient compressible and non-skid or Agrabby≅ material such as natural latex rubber or other suitable polymeric alternatives. With the horizontal members 120 and 122 placed over the handle as shown, a downward force is applied to the work surface 104. Horizontal member 122 is biased against the forward sections of the extensible handle support members 106, while horizontal member 120 is biased against the back surfaces of the extensible handle support members 106. A secure frictional pinching or compression engagement will take place between the horizontal members 120 and 122 and the extensible handle support members 106.

A pair of 116 on both sides of this second embodiment (only one of the pins is visible in FIG. 5) permit adjustment of the front-to-back distance of vertical opening between the two parallel members 120 and 122 so that the resulting assembly may readily fit over various thickness' of vertical extensible handle support members 106 associated with a wide variety of luggage units. Although such thickness' for currently available units is in the range of δ"–:", the flexibility of the invention enables it to accomodate a much wider range.

Figure 6:
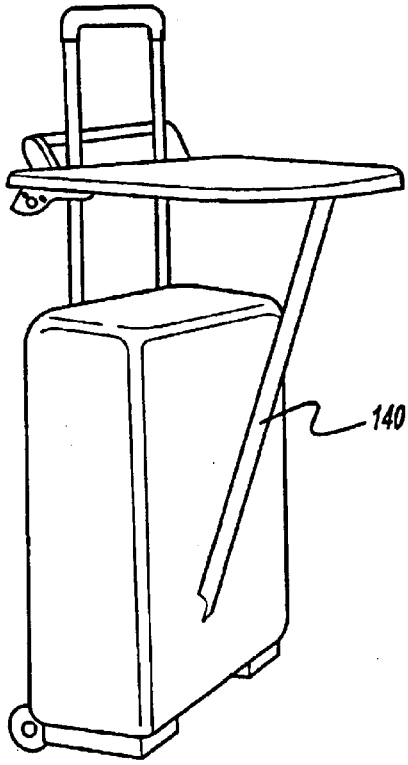
FIG. 6 is a perspective view of the second embodiment of the present invention utilizing a strap connection.

As mentioned previously, the work surface 104 of the second embodiment of the invention is frictionally secured on the vertical extensible handle support members 106 of the luggage carrier by placing slight downward pressure on the work surface 104. Preferably, such downward pressure may be applied through one or more steps 140, or through an extensible leg 150 with a base unit 160 adapted for accommodation beneath the luggage or carrier components, as shown in FIGS. 6 and 7.

The choice of which pressure-applying mechanisms is most appropriated depends upon several key variables, including the base depth of the wheeled luggage unit. For example, the strap 140 option should be used when the front-to-back depth of the wheeled luggage unit is 10 inches or greater with the force on the work surface 104 not exceeding 20 pounds, and/or when the lateral forces experienced by the work surface 104 are not excessive during use. The leg 150 should be used when the front-to-back depth of the wheeled luggage unit is less than 10 inches, when the load on the work surface 104 exceeds 20 pounds or whenever the usage of the work surface 104 is subject to particularly vigorous side-to-side or front-to-back forces.

As shown in FIG. 5, a strap 140 or leg 150 is preferable placed at position 130, though other positions 132 and 134 may be used instead of, or in conjunction with, the placement at 130. The strap 140 material is preferably of a nonelastic variety and includes an adjustment device enabling one of its ends to be removably connected to the front underside of the work surface 104. The other end of the strap 140 is then anchored to some point on the luggage or frame below the luggage via any appropriate means such as hooks, buckles or Velcro® as shown in FIG. 6. When the strap 140 is shortened by the adjustment device, the strap 140 will be in tension and will pull the work surface 104 slightly. This tensioning will frictionally engage the horizontal members 120 to the extensible handle support members 106 as previously described. Disengagement of the strap 140 at either end or significantly loosening the adjustment device will release the work surface 104. The work surface 104 will then spring slightly upward to a level position for storage or to reposition the work surface 104 at a more convenient level on the handle support members 106.

Figure 7:
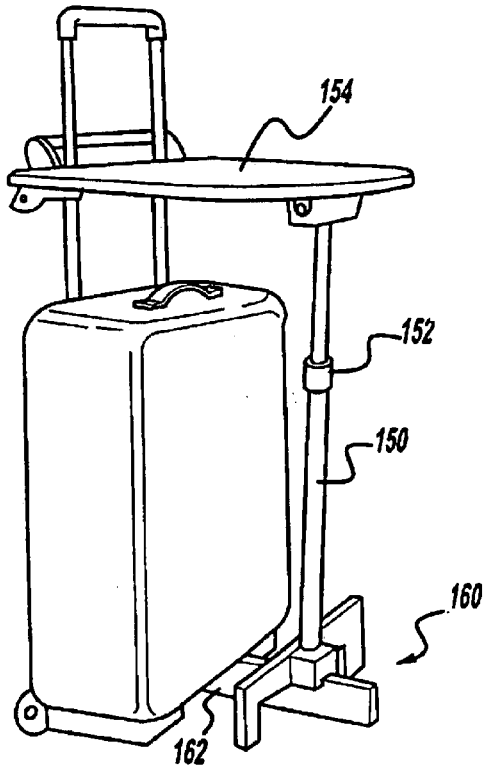
FIG. 7 is a perspective view of the second embodiment of the present invention utilizing a leg support.

FIG. 7 is a perspective view of the second embodiment of the present invention illustrating the leg 150 and base unit 160. The bottom end of the leg 150 is coupled to the base unit 160. The objective of the leg 150 is to generate sufficient downward pressure on the work surface 154 to frictionally lock it into position, while also stabilizing the entire unit. The leg 150 is preferably a two-piece construction including a manually operable tightening/loosening portion such as textured ring 152, enabling the length of the leg 150 to be adjusted in a telescopic fashion. Other adjustment means such as the adjustment pin 40 described in a previous embodiment may also be used to vary the length of leg 150.

Making particular reference to FIG. 7, the leg 150 includes an upper portion which is removably and preferably hinged to the front underside surface of the work surface 154. As previously described, the bottom portion of the leg 150 includes an outer tube which transitions into a base unit 160 that rests on the floor. The base unit 160 preferably includes a member 162 which fits under the front edge of the luggage or frame at floor level. With the element 152 in a loosened state, the upper portion of the leg assembly may be shortened, causing the work surface 154 to be pulled-slightly downward. This shortening frictionally secures the work surface 154 to the extensible handle support members 106 as previously described, at which point the device 152 may be tightened to hold the resulting configuration in place.

FIG. 7 further illustrates that base unit 160 may take the form of an assembly having criss-cross members which may be folded relative to one another for a more compact storage capability. In the preferred embodiment, the assembly may be provided with locking means to ensure that after unfolding, the members remain in a locked position. A pin may be laterally inserted through adjustment holes in both like pieces to provide this locking function. When the base is locked and fitted underneath the luggage/frame at the floor, and with the length of the leg adjusted to apply sufficient downward pressure on the work surface 154, the overall structure assumes a very stable configuration.

Figure 8:
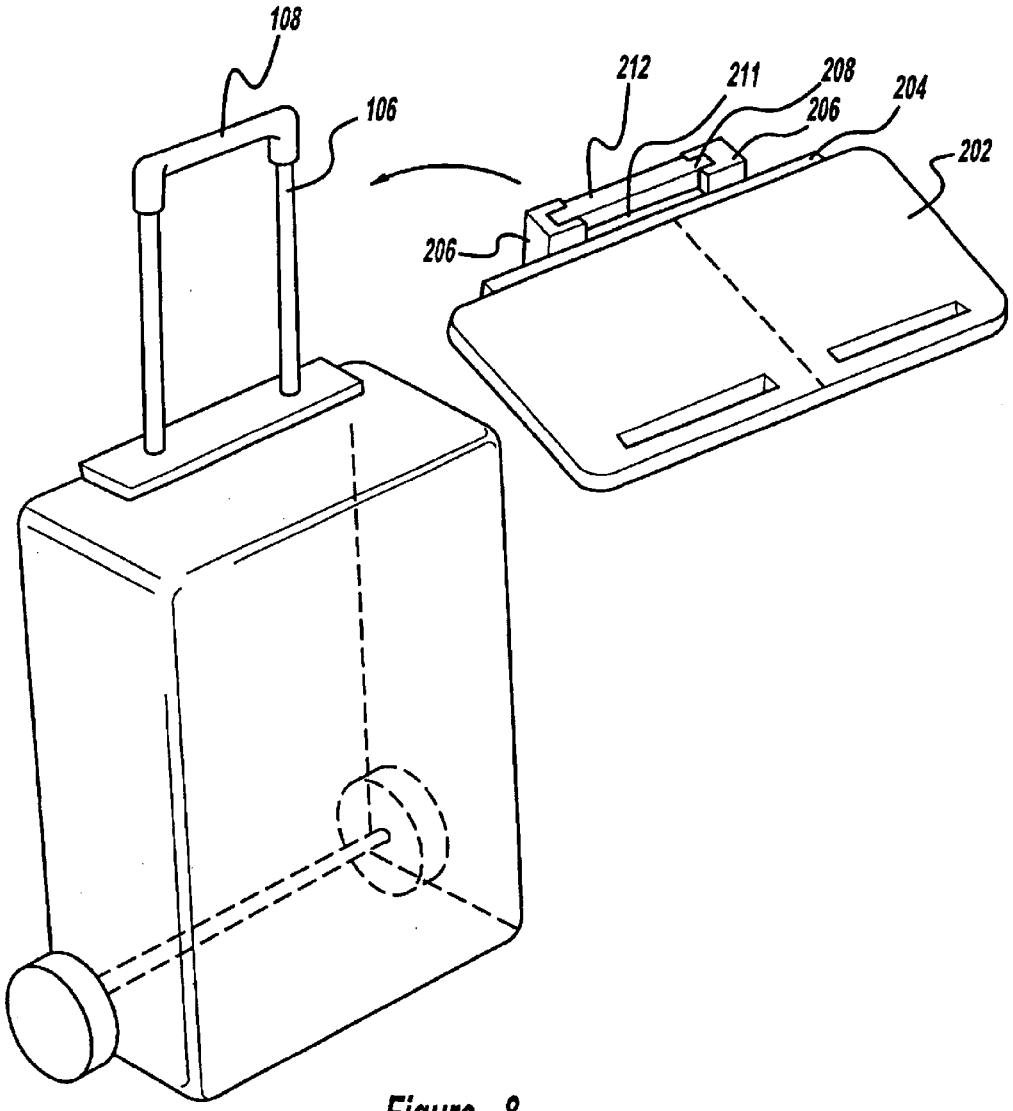
FIG. 8 is a perspective of the third embodiment of the present invention.

FIG. 8 is an oblique perspective of a third embodiment of the present invention where the luggage extensible handle support members 106 are grasped from their exterior sides 210. In this embodiment, a work surface 202 includes a rear edge having a track 204 into which opposing rigid bodies 206 slidingly engage. These rigid bodies each have contoured sections 208 facing toward one another. These contour sections 208 are generally cylindrical in cross section and preferably include compressible resilient pads that grip the extensible handle support members 106 on their exterior sides 210. These compressible resilient pads slip over the extensible handle support members 106 when the rigid bodies 206 are pulled apart. This simple pulling action aids in level adjustment and the removal of the work surface 202.

To bias the bodies 206 toward one another, different tensioning mechanisms may be used, such as a pair of elastic bands 211 and 212. As an alternative, springs may be used, the choice in tensioning mechanisms depending upon the way in which bodies 206 slidingly engage with track 204. The additional rearward biasing element such as elastic band 212 may be omitted if the engagement between the bodies 206 and the track 204 is sufficiently controlled. In this case, the user need only pull the two bodies 206 apart and place the assembly onto the extensible handle support members 106 of the handle assembly. If a rearward elastic band such as 212 were to be used, the assembly would have to be brought down over the top of the handle assembly.

Figure 9:
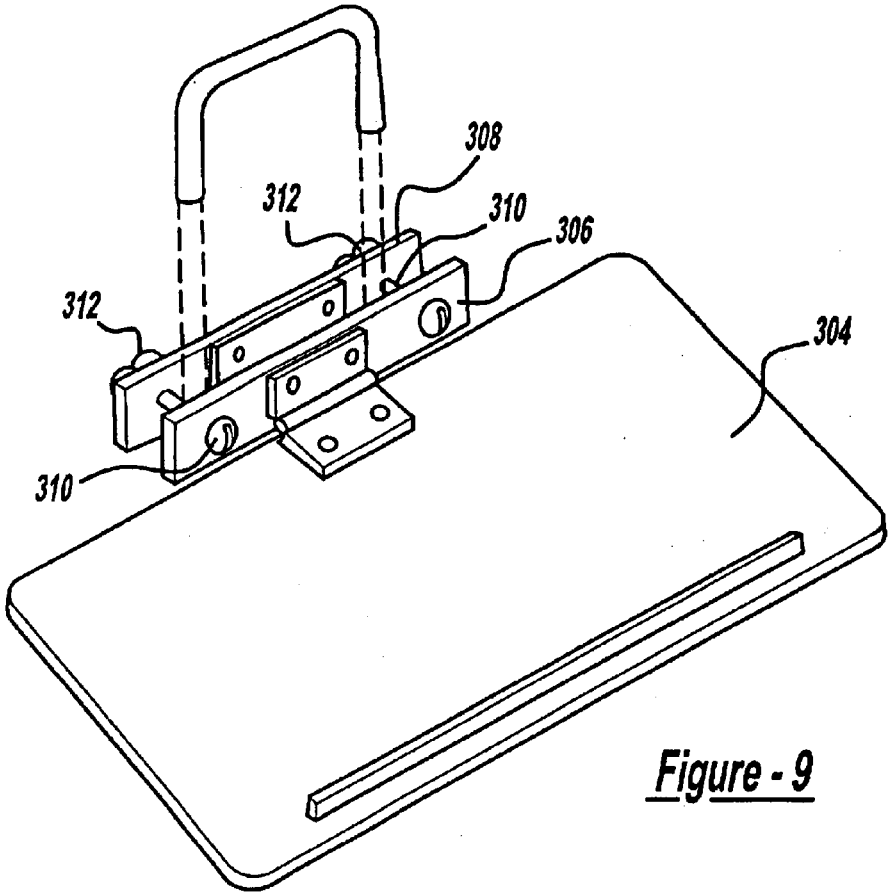
FIG. 9 is a perspective of the fourth embodiment of the present invention.

FIG. 9 illustrates a fourth embodiment of the present invention where the vertical extensible handle support members 106 are grasped by an engaging means from the front and back. This fourth embodiment executes this capability with first and second clamping members, 306 and 308, which are respectively brought together and apart through use of a pair of manually adjustable fasteners in the form of bolts 310 coupling to wing nuts 312. It will be apparent to one skilled in the art that other types of clamping mechanisms may alternatively be used, including cams and levers facilitating quicker and more forceful engagement and/or release.

Although the shaft of fasteners 310 may be positioned more closely toward one another in the preferred embodiment, they are sufficiently spaced apart so as to be on the outside of the handle assembly. In this manner this embodiment of the invention is also applicable to luggage carrier handle assemblies having one piece extensible handle support members as well as those having a plurality of extensible handle support members. Attached to the forward clamping member 306 is a work surface 304 which in the preferred embodiment is hingedly affixed to the member 306. This facilitates an adjustment of tilt angle relative to a user. Once adjusted, the surface 304 may be locked into place at a particular tilt angle using a variety of mechanisms, including the use of rod assemblies and legs discussed in previous embodiments.

Figure 10:
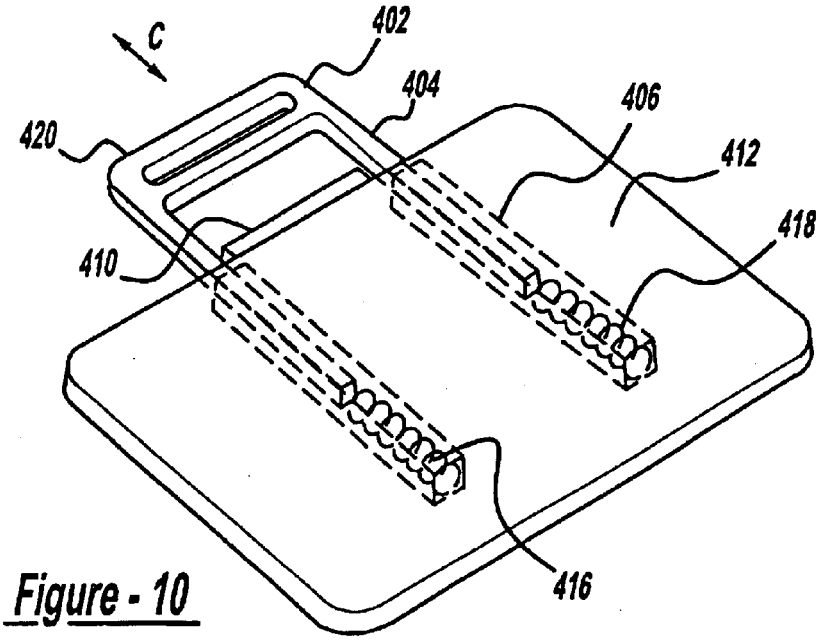
FIG. 10 is a perspective of the fifth embodiment of the present invention.
Figure 11:
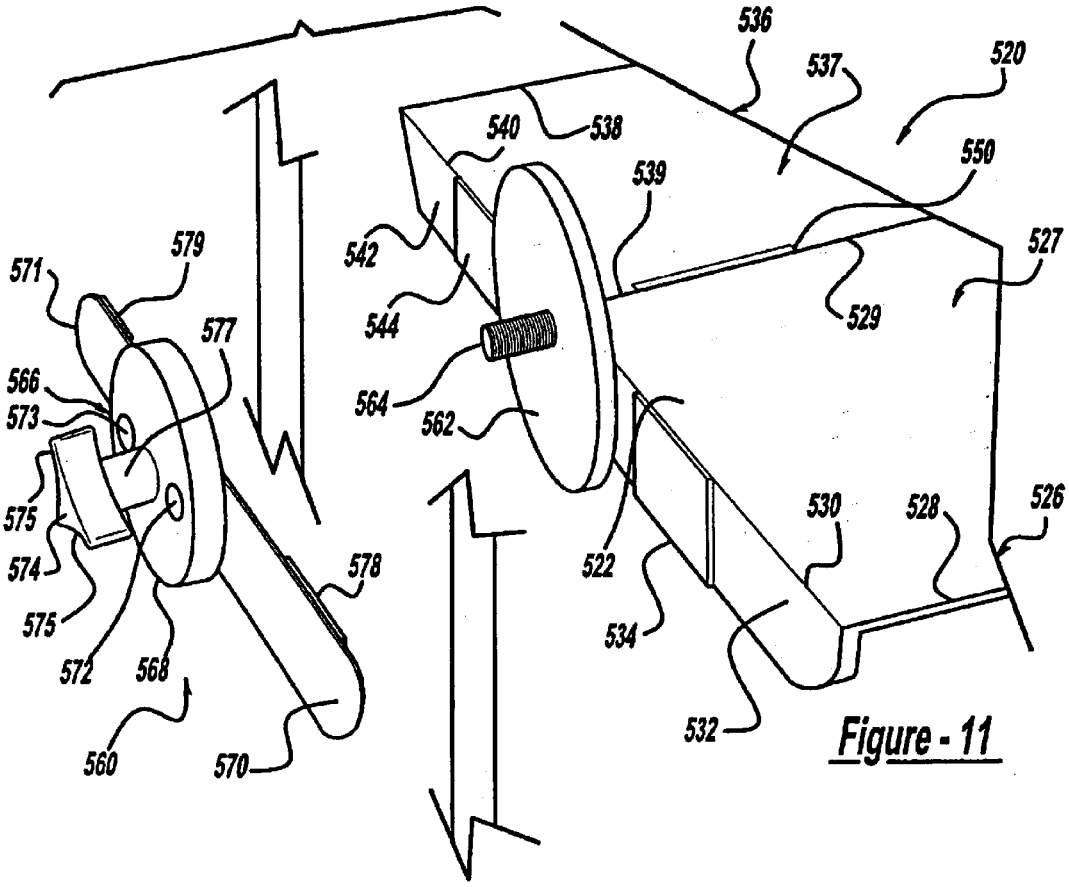
FIG. 11 is an exploded view of the clamp of the sixth embodiment of the present invention.
Figure 12:
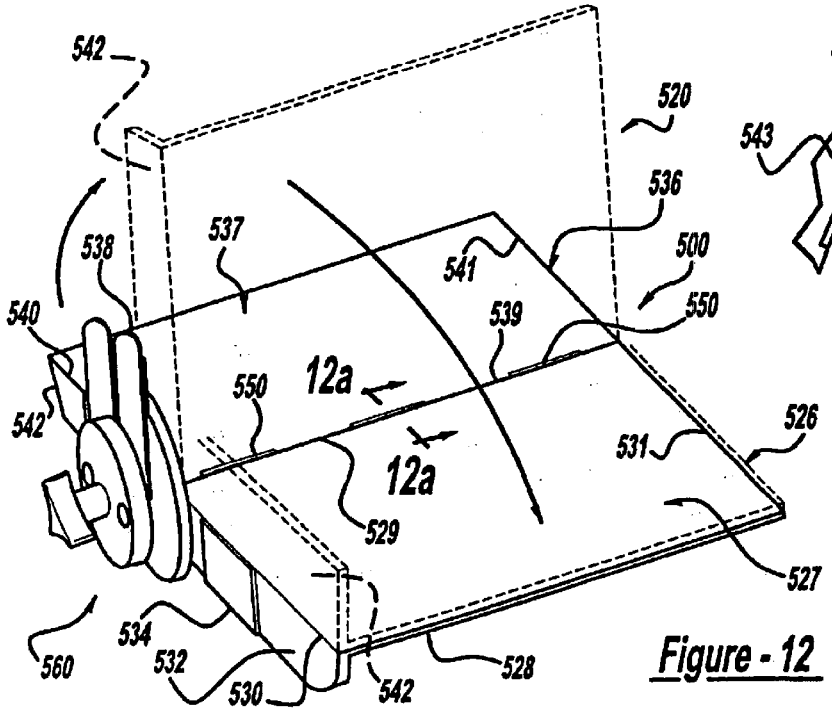
FIG. 12 is a folded view of the sixth embodiment of the present invention.
Figure 12A:
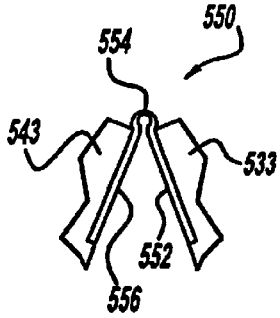
FIG. 12*a* is a sectional view of the hinge along 12*a*—12*a* of FIG. 12.
Figure 13:
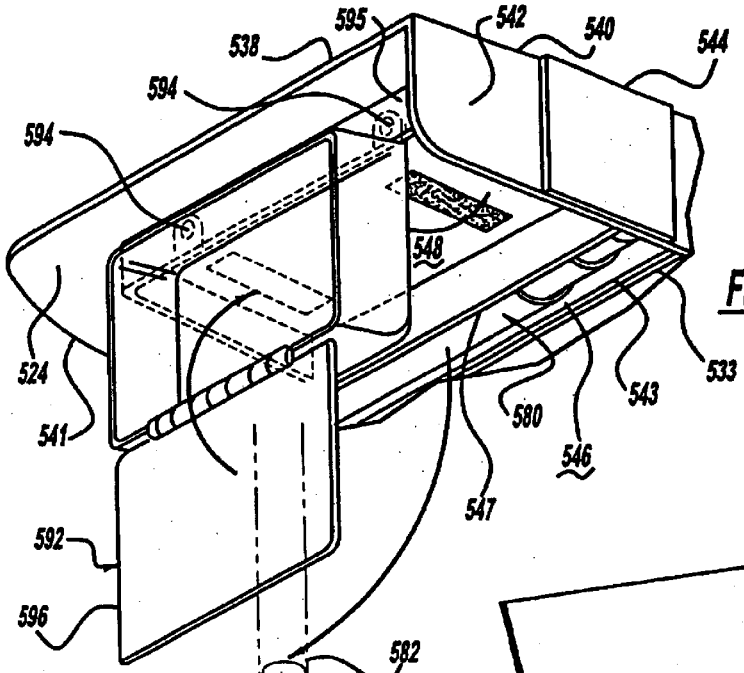
FIG. 13 is a bottom perspective view of the storage pouch of the sixth embodiment of the present invention.

Reference is now made to FIG. 10, which shows a front-to-back clamping arrangement in the spirit of the fourth embodiment. In this fifth embodiment, a spring loaded clamping mechanism is used to engage the present invention with the vertical extensible handle support members 106 of a luggage carrier. A U-shaped member 402 includes two parallel ends 404 which are guided by tracks 406 and spring-loaded to bias a rearward member 408 toward a rearward edge 410 of a work surface 412. In the present embodiment, a pair of springs 416 and 418 are utilized to provide bias loading. A handle 420 is also preferably provided to the rearward-most aspect of the member 402 to facilitate a more convenient operation described below.

To install the apparatus of FIG. 10, a user simply uses one hand to grasp the work surface 412 proper and employs the other hand to bias the rearward member 408 and rearward edge 410 of the work surface 412 in the direction of arrow C. This biasing creates a space between rearward member 408 and edge 410 that is sufficiently large to be placed over the luggage carrier handle assembly. When the work surface 412 is set at a desirable height, the user may reduce force on the handle to allow the rearward member 408 to move toward the rearward edge 410. The bias of the springs 416 and 418 will grasp the front and back portions of the extensible handle support members 106 of the luggage carrier. As in the case of other embodiments described herein, the surfaces associated with the grasping of the handle assembly may be provided with a frictional compressible material such as rubber to enhance the frictional engagement.

The sixth embodiment according to the present invention is shown in FIGS. 11–16. This embodiment includes a work station 520 and a hinge 550, a clamp 560 and a rod assembly 580.

The work station 520 includes a pair of support halves. The first support half 526 is connected to the second support half 536 by the hinge 550. The first support half 526 and the second support half 536 are preferably in the shape of a rectangle, however, this is not to be taken as a limitation of the invention. Other shapes, such as a polygon, are optional. The first support half 526 has four peripheral edges 528, 529, 530, 531 which define the extremities of the first support half 526. Similarly, the second support half 536 has four peripheral edges 538, 539, 540, 541 which define the extremities of the second support half 536. The first support half 526 has a support flange 532 along peripheral edge 530. The support flange 532 acts to stiffen the first support half 526 so that it minimizes deflection of the top surface when an object is placed on the support half 526. Likewise, the second support half 536 has a support flange 542. The flange 532 has a friction portion 534 and the flange 542 has a friction portion 544. The friction portions 534, 544 are each made of a thin elastomeric layer having an adhesive backing so that they each may be adhesively bonded to their respective support flanges.

The support half 536 has a stiffener 543 along edge 539 which is substantially perpendicular to the support flange 542 at one end and at the other end they are joined by a third flange 547 to form a partial cavity 546. The purpose of the partial cavity 546 will be described later on. Those skilled in the art will recognize that the support half 526 may also be constructed with stiffener 533.

As stated earlier, the first half 526 is connected to the second half 536 by the hinge 550, or preferably a series of hinges. The hinge 550 permits the first and second halves 526, 536, to take one of two positions. In a first position, the first half 526 is pivoted about the hinge 550 so that the top surface 527 of the first half 526 is adjacent to the top surface 537 of the second half 536. In the other position, the top surfaces 527 and 537 form a work surface 22 upon which a laptop computer 21 may be placed.

The hinge member 550 includes a first portion 552 adhesively attached to stiffener 533 and a second portion 556 adhesively attached to stiffener 543. The intermediate portion 554 joins the first and second halves 526, 536 together so as to form a flat work surface 22 when the stiffeners 533, 543 are adjacent to each other and the hinge 533 prevents over-rotating of the surfaces 527, 537. The intermediate portion 554 is preferably thinner than the first and second portions 552, 556. The hinge 550 may be made of thermoplastic elastomer material or a metalocene plastomer, both of which exhibit good high cycle fatigue properties. Alternately, the hinge 550 may be co-extruded such that the first and second portions 552, 556 are suitable for adhesively securing the hinge 550 to the stiffeners 533, 543 and the intermediate portion 554 is sufficiently pliable to form a durable hinge. For example, hinge 550 may be co-extruded with a glueable acrylic or ABS plastic material for first and second portions 552, 556 and a flexible polypropylene or polyethylene material for intermediate portion 554. The number of hinges 550 used to connect the first support surface to the second support surface may vary from a minimum of one up to any number as the design may dictate.

The clamp 560 includes a disk 562 and a threaded member 564 which extend substantially perpendicular to the planar surface of the disk 562. A portion of the disk 562 is fastened to one of the support flanges 532, 542, but not to both, in order to facilitate folding of the first support half 526 to the second support half 536. The clamp 560 also includes a jaw 566 having a disk 568, with a central aperture 569, and a pair of elongated arms 570, 571. The arms 570, 571 pivot about rivets 572, 573 in the disk 568. Thus, the arms 570, 571 can pivot about their respective rivet members 572, 573 in order to take one of two positions. In a first position, arm 570 extends in an orientation aligned with, but spaced away from, support flange 532 and the arm 571 extends in an orientation aligned with, but spaced away from, support flange 542. A pair of stops (not shown) may extend from disk 568 and function to locate and orientate arms 570, 572 in a desired extended position. As presently preferred, the stops take the form of a pair of pins extending from disk 568 towards disk 562. Alternately, the steps may be formed integrally on disk 568. In another position, the arms 570, 572, fold toward one another to be substantially parallel to each other so as to be in a compact, folded condition. This position is preferably done when the top 527 is folded adjacent to the top 537. The clamp 550 is also provided with a thumb wheel or knob 574 which has an aperture portion and a threaded portion 577. The 574 knob has a plurality of finger engaging surfaces 575 to rotate the knob 574.

As stated earlier, the disk 568 has an aperture 569 which permits the threaded member 564 to extend through the disk 568 so that the threaded portion 577 of the knob 574 engages the threaded member 564. The knob 574 advances the disk 568 toward the disk 562 when the knob is turned in one direction. In the other direction of turning, the disk 568 separates from the disk 562. The arm 570 has a friction surface 578 and the arm 571 has a friction surface 579 so that any freestanding upright support may be clamped between the support flanges 532, 542 and the jaw 566. To enhance the friction gripping capability of the jaw 566, arms 570, 571 are provided with friction members 578, 579. The friction members 578, 579, are each made of a thin elastomeric member having an adhesive backing so that each may be adhesively bonded to their respective supports. An elastomeric material having a thickness in the range of 1/32–1/16 of an inch sold as Bumpon resilient rollstock by Minnesota Mining and Manufacturing Co. (3M) and in particular Model No. SJ 6032 has been found to have desirable friction and compliance to adequately secure the work station to the upright support. However, one skilled in the art will recognize that the suitable materials may be available.

As stated earlier, the first support half has a second stiffener 547 adjacent but spaced apart from another stiffener 543 forming a partial cavity 546. A rod assembly 580 is disposed in the partial cavity 546. The rod 580 includes a first extensible rod 582 and a second extensible rod 584. Optionally, the rod assembly 580 can also include a third extensible rod 586 with a foot or cap on its end. A pair of pivot flanges 602 extend from the stiffener flanges 543, 547 located beneath the work surface. A pin 604 extends between the pivot flanges 602 to pivotally attach the rod 580 thereto. A pin 606 is disposed in the first rod 582. The pin 606 is biased by a spring into apertures 608 formed in one or both of the pair of adjacent flanges 602 to lock the rod assembly 580 in a support condition for the work station.

The first rod 582 is larger in diameter than the second rod 584 so as to permit the second rod to nest inside the first rod 582. The nesting of the second rod into the first rod permits the rod assembly 580, when collapsed, to be stowed in the partial cavity 546. The cavity 546 is formed on the opposite or back side 524 of the work station 520. When the portable work station is being used to support a laptop computer, the rod 580 swings down out of the cavity 546 and the second rod 584 is longitudinally extended out of the first extensible member and locked into position by means of a cam lock or other mechanism well known in the art of telescoping members. In one angular position the cam lock allows the second rod to nest within the first rod 582, and by twisting the cam lock in one angular direction or rotation, the cam locks the second rod 584 axially to the first rod. The rod assembly 580 is secured in the stored or extended position by the pin 604 or other similar mechanism.

The work station 520 may optionally include a storage pouch 592 attached to the opposite side 524 by means of eyelets and fasteners 594 to flanges 595 defining a cavity 548 on the opposite side 534. In a first preferred form, the pouch 592 defines a rectangular compartment with a lid 596 that may be zippered closed thereto. Alternately, the pouch 592 may take the form of an expandable folder for holding various documents or other folders. In this manner, documents are readily accessible to the user and the work station is opened and the folder deployed. The storage pouch 592 fits within the cavity 548 on the opposite side 524 of the work station 520. The cavity 548 may be partially formed by the stiffener 547 and the support flange 542, which forms a four sided structure with flange 595 to define the partial cavity 548. The pouch 592 may be fastened up in the cavity 548, by means of Velcro® strips, to the opposite side 524.

Figure 14:
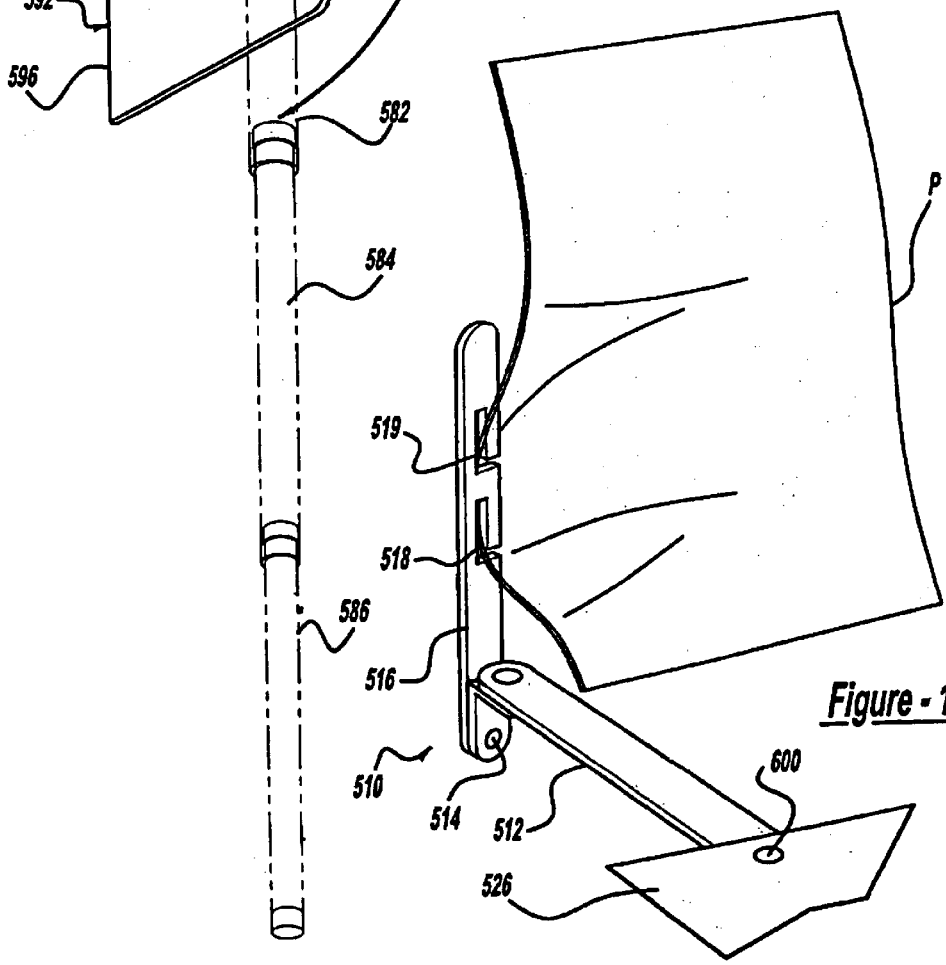
FIG. 14 is a partial perspective view of the paper document holder of the sixth embodiment of the present invention.
Figure 15:
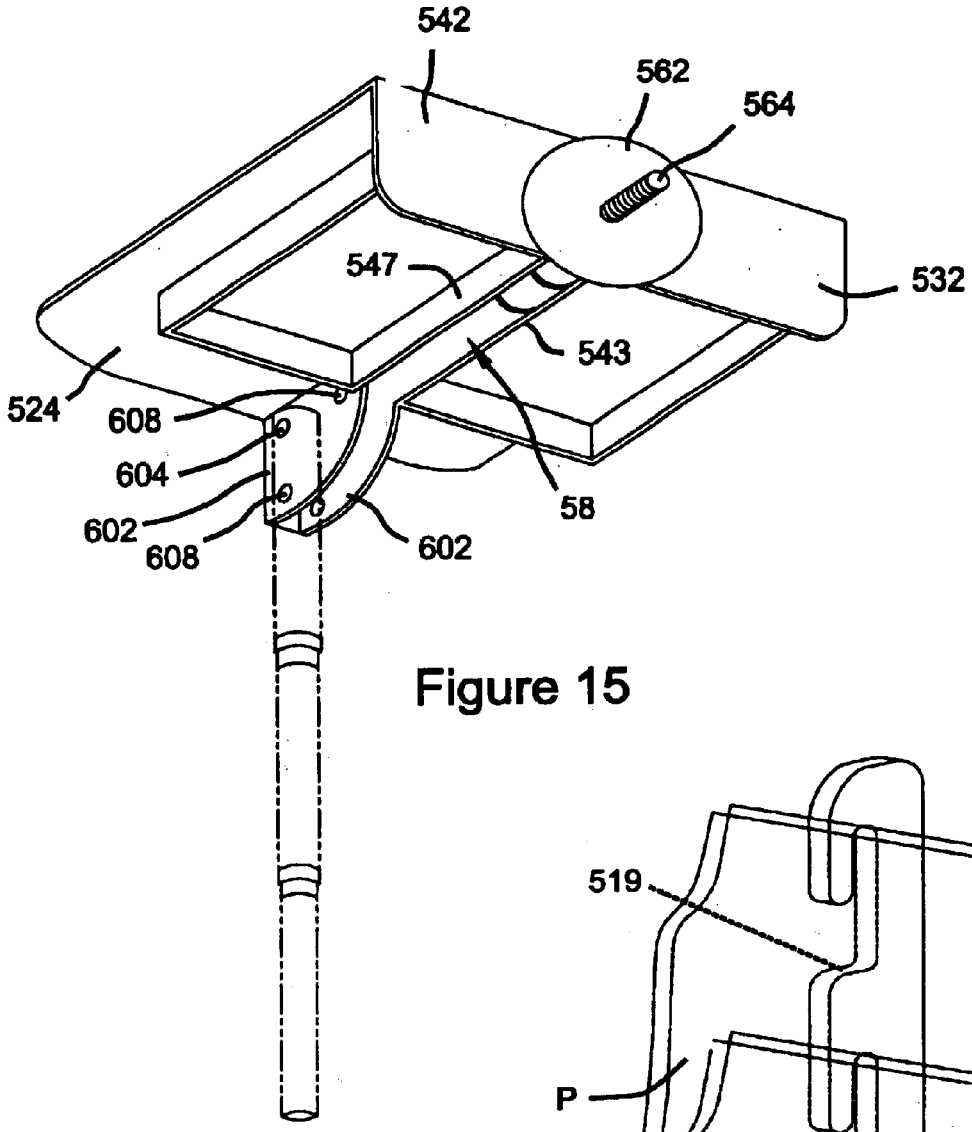
FIG. 15 is a bottom perspective view similar to that shown in FIG. 13.
Figure 16:
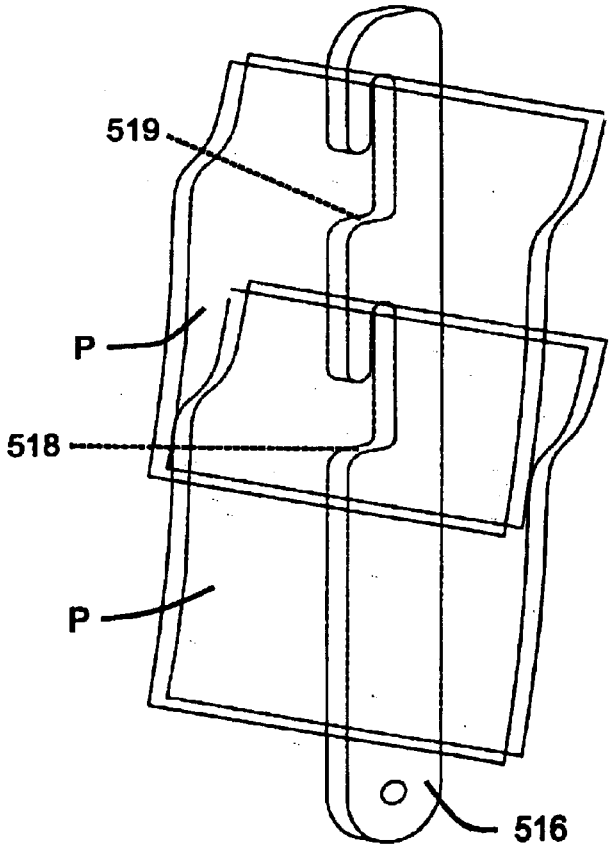
FIG. 16 is a partial perspective view of the document holder showing an alternate orientation for positioning the paper.

The portable work station may also optionally include a document holder 510. The holder 510 is pivotably mounted at 600 to the first support half 526 or, optionally, to the second support half 536. The holder 510 includes a first elongated flat rod 512, an angular pivot member 514 and a second elongated flat rod 516. The pivot member 514 is mounted to the one end of the first rod 512 by means of a rivet. The second rod 516 is mounted at the other end of the pivot 514 by another rivet to form an L-shaped holder. The second rod 516 has a pair of L-shaped cutouts 518, 519 to permit a document P to be inserted into each of the L-shaped cutouts 518, 519, which capture the document P between them so as to frictionally retain the document P therein as seen in FIG. 14. Alternately, the documents P may be positioned vertically such that the upper edge of the paper is inserted into the cutouts as seen in FIG. 16. In this manner, multiple layers of documents are readily accessible to the user. When the portable work station 520 is in a storage position, the second rod 516 is rotated ninety degrees about its rivet in the pivot 514. The pivot 514 and second rod 516 are in turn rotated ninety degrees relative to the first rod 512 positioning them beneath the first rod 572. The first rod 512 swings about pivot point 600 under the work station on the opposite side 524 of the station 500.

When the portable work station 500 is used in connection with the laptop computer 21, the user pivots the first support half 526 away from the second support half 536 in order to form the substantially flat work surface 22. The clamp 560 is positioned next to a freestanding upright support (not shown in FIGS. 12–16), such as for example, an extensible luggage handle or a freestanding, vertically extending column or baluster of a railing, and the knob 574 is rotated by engaging the surfaces 575 in a rotational manner so that an internally threaded portion 577 engages the threaded member 564 to advance the arms 570, 571 toward the disk 562. Continuing the rotational movement of the knob 574 causes the upright support members to be sandwiched or clamped between the arms 570, 571 and the support flanges 532, 542, respectively. As the knob 574 advances further in the clamping condition, one or more freestanding upright supports is engaged by the friction portion 534 and, friction portion 544, and the work station 520 is secured to the upright support.

Optionally, in order to provide further stability for the flat work surface 22, the rod assembly 580 is rotated about a pin 604 and the second rod 584 is moved out of its nesting condition in the first rod and the cam lock 588 is rotated so as to lock the second rod 584 relative to the first rod 582. The cap or foot portion of the rod assembly 580 engages a support surface (not shown), such as a floor, to support of the work station 520. The rod assembly 580 is further locked into position by having the spring loaded pin 606 engage an aperture 608 in one support edge. Thus, the work surface 22 provides a temporary planar work surface from which a laptop computer 21 or other office device may be operated.

Preferably, the work station 520 is made of a polymeric material such as thermoplastic or thermoset plastic. Alternatively, the work station 520 may be made of metal, wood or any other material suitable for the application. A non-slip surface is preferably formed on the planar work surface. Examples of such non-slip surfaces include a textured or roughened surface formed in the work surface. Alternately, a coating or additional layer of non-slip material may be adhered to the top of the work surface.

It is to be understood that the invention is not limited to the exact construction illustrated and described above, but that various changes and modifications may be made without departing from the spirit and scope of the invention as defined in the following claims.

What is claimed is:

1. A portable work station comprising:

a luggage carrier having a handle;

a support member having a first portion, a second portion and a hinge interconnecting said first and second portions, said second portion being movable relative to said first portion between a closed position wherein said first and second portions are arranged in a facing relationship and an open position wherein said first and second surfaces are arranged in a side-by-side relationship to form a generally planer work surface;

a clamping mechanism releasably securing said support member to said handle; and a leg pivotally coupled to said first portion, said leg being movable relative to said first portion between a stowed portion wherein said leg is adjacent said support member and an extended position wherein said leg extends away from said support member.

2. The portable work station as claimed in claim 1 wherein said leg comprises a collapsible rod assembly attached to said support member and adjustable to vary the height of said work surface relative to ground level.

3. The portable work station as claimed in claim 1 wherein said hinge includes a first hinge plate secured to said first portion and a second hinge plate secured to said second portion of said work surface and a hinge portion interposed between said first and second hinge plate.

4. The portable work station as claimed in claim 3 wherein said hinge is comprised of a polymeric material.

5. The portable work station as claimed in claim 4 wherein said hinge comprises said first and second hinge plates being formed of a glueable plastic material and said hinge portion being formed of a flexible plastic material.

6. The portable work station as claimed in claim 4 wherein said hinge is a co-extruded member wherein said first and second portions are formed of a glueable plastic material selected from the group consisting of acrylic and ABS, and said hinge portion is formed of a flexible plastic material selected from the group consisting of polyethylene and polypropylene.

7. The portable work station as claimed in claim 1 wherein said clamping mechanism comprises:

a clamping flange formed on each of said first and second portions of said support member; and a clamping member positionable relative to said clamping flange and engageable with said support member releasably securing said support member to said handle.

8. The portable work station as claimed in claim 7 wherein said clamping mechanism further comprises a friction-enhancing material interposed between said clamping flange and said clamping member.

9. The portable work station as claimed in claim 1 further comprising a document holder operably coupled to at least one of said first and second portions, said document holder being positionable between a stowed position and a use position.

10. The portable work station as claimed in claim 9 wherein said document holder comprises a first arm coupled to at least one of said first and second portions and a second arm pivotally coupled to said first arm, said second arm having an L-shaped slot formed therein.

11. The portable work station as claimed in claim 1 further comprising a storage pouch operably coupled to at least one of said first and second portions, said storage pouch being positionable between a stowed position and a use position.

* * * * *